US007594369B2

(12) United States Patent
Kelly

(10) Patent No.: US 7,594,369 B2
(45) Date of Patent: Sep. 29, 2009

(54) SYSTEM AND METHOD FOR WATERPROOFING PARAPET WALLS

(76) Inventor: Thomas L. Kelly, 31 Sands St., Waterbury, CT (US) 06710

( * ) Notice: Subject to any disclaimer, the term of this patent is extended or adjusted under 35 U.S.C. 154(b) by 81 days.

(21) Appl. No.: 11/848,720

(22) Filed: Aug. 31, 2007

(65) Prior Publication Data

US 2009/0056262 A1 Mar. 5, 2009

(51) Int. Cl.

| | |
|---|---|
| ***E04B 1/70*** | (2006.01) |
| ***E04H 12/00*** | (2006.01) |
| ***E04F 17/00*** | (2006.01) |
| ***E04B 1/00*** | (2006.01) |
| ***E04B 5/00*** | (2006.01) |

(52) U.S. Cl. ..... 52/302.3; 52/58; 52/300; 52/409; 52/741.1; 52/746.12; 52/748.1

(58) Field of Classification Search ..... 52/408, 52/56, 61, 62, 300, 59, 302.1, 302.6, 302.3, 52/409, 741.1, 746.12, 748.1
See application file for complete search history.

(56) References Cited

U.S. PATENT DOCUMENTS

| | | | | | |
|---|---|---|---|---|---|
| 1,154,435 | A | * | 9/1915 | Renaud | 52/58 |
| 1,731,328 | A | * | 10/1929 | Witter | 52/58 |
| 1,967,105 | A | * | 7/1934 | Seymour | 52/58 |
| 2,017,106 | A | * | 10/1935 | Sandell | 428/175 |
| 2,121,372 | A | * | 6/1938 | Tucker | 52/62 |
| 2,134,275 | A | * | 10/1938 | Ness | 52/61 |
| 2,191,522 | A | * | 2/1940 | Eckert | 52/415 |
| 2,226,369 | A | * | 12/1940 | Campfield | 52/59 |
| 2,226,886 | A | * | 12/1940 | Willis | 52/62 |
| 2,271,143 | A | * | 1/1942 | Martinus | 52/58 |
| 2,413,588 | A | * | 12/1946 | Smith | 52/58 |
| 3,483,664 | A | * | 12/1969 | Malone, Jr. et al. | 52/309.6 |
| 3,763,605 | A | * | 10/1973 | Freeman | 52/58 |
| 3,979,860 | A | * | 9/1976 | Roth et al. | 52/61 |
| 4,386,981 | A | * | 6/1983 | Clapperton | 156/71 |
| 4,530,193 | A | * | 7/1985 | Ochs | 52/408 |
| 4,841,687 | A | * | 6/1989 | Navetta | 52/58 |
| 4,932,171 | A | * | 6/1990 | Beattie | 52/58 |
| 4,996,801 | A | * | 3/1991 | Ristow et al. | 52/58 |
| 5,381,632 | A | * | 1/1995 | Damron | 52/58 |
| 5,469,671 | A | * | 11/1995 | Rathgeber et al. | 52/58 |
| 5,593,748 | A | * | 1/1997 | Hubbard | 428/41.3 |

(Continued)

OTHER PUBLICATIONS http://www.combocrete.com/document/tech02.pdf, May 20, 2007.*

*Primary Examiner*—Robert J Canfield
*Assistant Examiner*—Babajide Demuren
(74) *Attorney, Agent, or Firm*—Cantor Colburn LLP

(57) ABSTRACT

Disclosed is a system for waterproofing interior surfaces of parapet walls disposed on a roof, wherein the parapet walls include an interior surface counter flashing and a surface cap. The system includes at least one waterproofing membrane configured to allow moisture to escape from a space between the at least one waterproofing membrane and the interior surfaces of the parapet walls, wherein the at least one waterproofing membrane is disposed to extend at least a portion of a distance along the interior surfaces from the surface cap to the roof from which the parapet walls extend. The system also includes a flap valve defined by the at least one waterproofing membrane, the flap valve being positioned between the surface cap and the roof.

20 Claims, 6 Drawing Sheets

U.S. PATENT DOCUMENTS 5,850,719 A * 12/1998 Mayle ..... 52/408
6,006,482 A * 12/1999 Kelly ..... 52/409
6,167,660 B1 * 1/2001 Sama ..... 52/58
6,945,005 B2 * 9/2005 Nunley ..... 52/650.3
2007/0094965 A1 * 5/2007 Mitchell ..... 52/302.1

* cited by examiner

SYSTEM AND METHOD FOR WATERPROOFING PARAPET WALLS

FIELD

The disclosure relates generally to a system and method for waterproofing parapet walls, and more particularly to a system and method for waterproofing parapet walls disposed on a roof.

BACKGROUND

Many roofs include parapet walls that extend a relatively short, upward distance from the top of the roof to which the walls are attached. These walls are provided on roofs for various reasons, including safety and aesthetics. Waterproofing parapet walls is obviously beneficial to the construction of the roofs from which parapet walls extend. Accordingly, a system and method for waterproofing these parapet walls would be desirable.

SUMMARY

Disclosed is a system for waterproofing interior surfaces of parapet walls disposed on a roof, wherein the parapet walls include an interior surface counter flashing and a surface cap. The system includes at least one waterproofing membrane configured to allow moisture to escape from a space between the at least one waterproofing membrane and the interior surfaces of the parapet walls, wherein the at least one waterproofing membrane is disposed to extend at least a portion of a distance along the interior surfaces from the surface cap to the roof from which the parapet walls extend. The system also includes a flap valve defined by the at least one waterproofing membrane, the flap valve being positioned between the surface cap and the roof.

Further disclosed is a method for waterproofing interior surfaces of parapet walls disposed on a roof, wherein the parapet walls include an interior surface counter flashing and a surface cap. The method includes disposing at least one waterproofing membrane to extend at least a portion of a way down the interior surfaces from the surface cap to the roof from which the parapet walls extend upwards, configuring the at least one waterproofing membrane to allow moisture to escape from a space between the at least one waterproofing membrane and the interior walls, providing a flap valve in the at least one waterproofing membrane, the flap valve being positioned between the surface cap and the roof, and removing the moisture from the space via the configuring and equalizing wind pressure on the at least one waterproofing membrane via the providing.

Still further disclosed are waterproof parapet walls disposed on a roof, the walls including interior surfaces disposed to face inwardly toward the roof, a counter flashing disposed on the interior surface, a surface cap disposed on an upper extent of the parapet walls, at least one waterproofing membrane disposed to extend at least a portion of a way down the interior surfaces from the surface cap to the roof from which the waterproof parapet walls extend upwards, wherein the at least one waterproofing membrane is configured to allow moisture to escape from a space between the at least one waterproofing membrane and the interior walls, and a flap valve defined by the at least one waterproofing membrane, the flap valve being positioned between the surface cap and the roof.

BRIEF DESCRIPTION OF THE FIGURES

Referring to the drawings wherein like elements are numbered alike in the several Figures.

DETAILED DESCRIPTION

Figure 1:
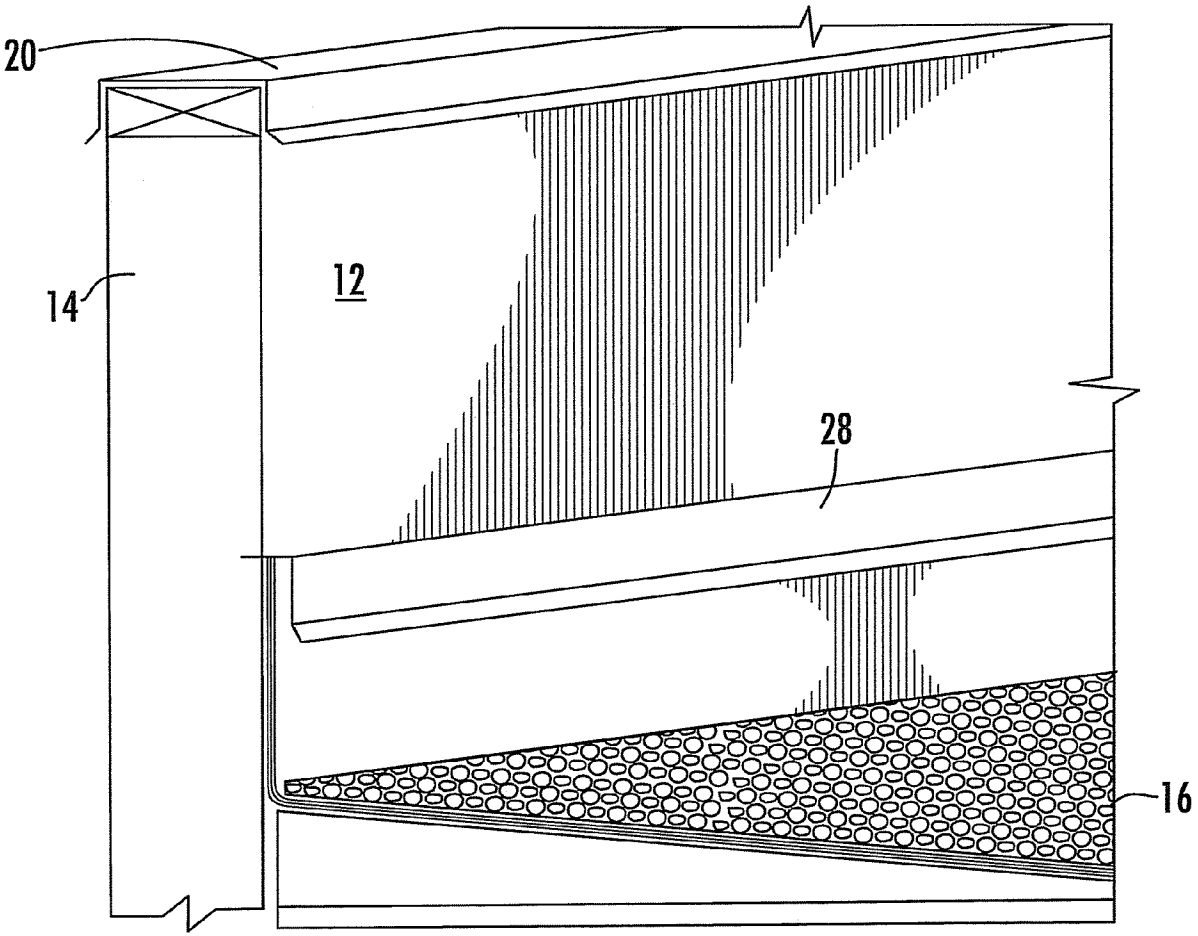
FIG. 1 is a schematic perspective view of a parapet wall and roof for use in a system for waterproofing interior surfaces of parapet walls.

Referring to FIGS. 1-6, a system 10 for waterproofing interior surfaces 12 of parapet walls 14 disposed on a roof 16 is illustrated. The system 10 includes at least one waterproofing membrane that extends towards the roof 16 from a surface cap 20 of the wall 14 to cover at least a portion of the interior surface 12 of the wall 14. In the exemplary embodiment of FIGS. 1-6, the at least one waterproofing membrane includes a skirt membrane 22, a field membrane 24, and a primary waterproofing membrane 26. Association of these membranes with the roof 16 and parapet walls 14 will be discussed hereinbelow, beginning with specific reference to FIG. 1.

FIG. 1 illustrates a previously existing parapet wall 14 extending from the roof 16, prior to application of any of the waterproofing membranes discussed above. As is shown in FIG. 1, the interior surface 12 of the parapet wall 14 includes a counter flashing 28, which extends about a third of a way up the wall 14. The counter flashing 28 may be strips of metal, roofing, or fabric anchored to a raglet (which is not illustrated, but may be formed within the walls 14) or attached to the interior surface 12 above the plane of the roof 16. As shown in FIG. 1, the counter flashing 28 is turned down towards the roof 16, so as to protect any base flashing and/or membrane already disposed on the wall 14 and/or roof 16 (i.e. flashing and/or membrane existing on the roof 16 and wall 14 prior to waterproofing membrane application).

Figure 2:
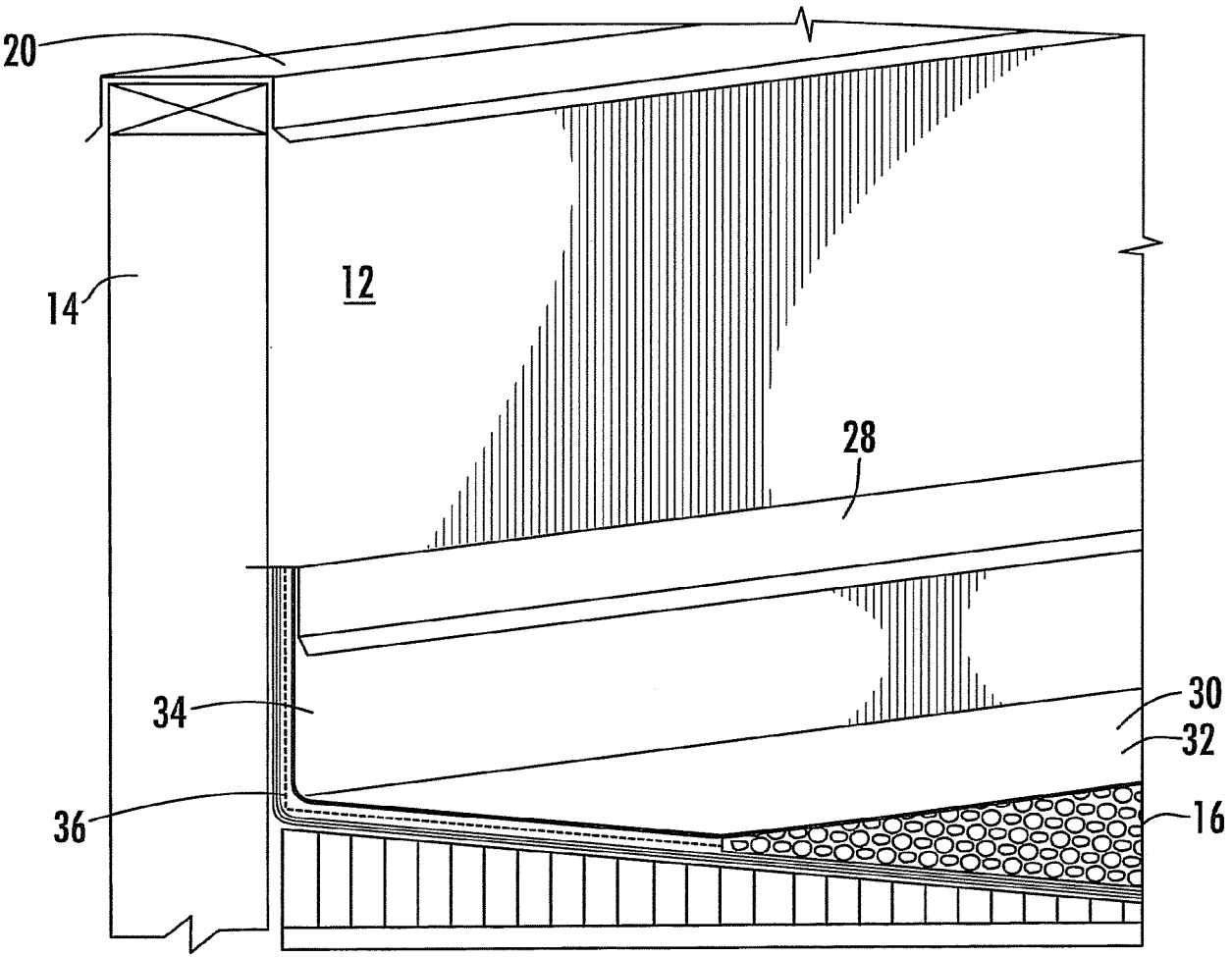
FIG. 2 is a schematic perspective view of the parapet wall and roof of FIG. 1, wherein part of an exemplary embodiment of the system for waterproofing interior surfaces of parapet walls is shown.
Figure 3:
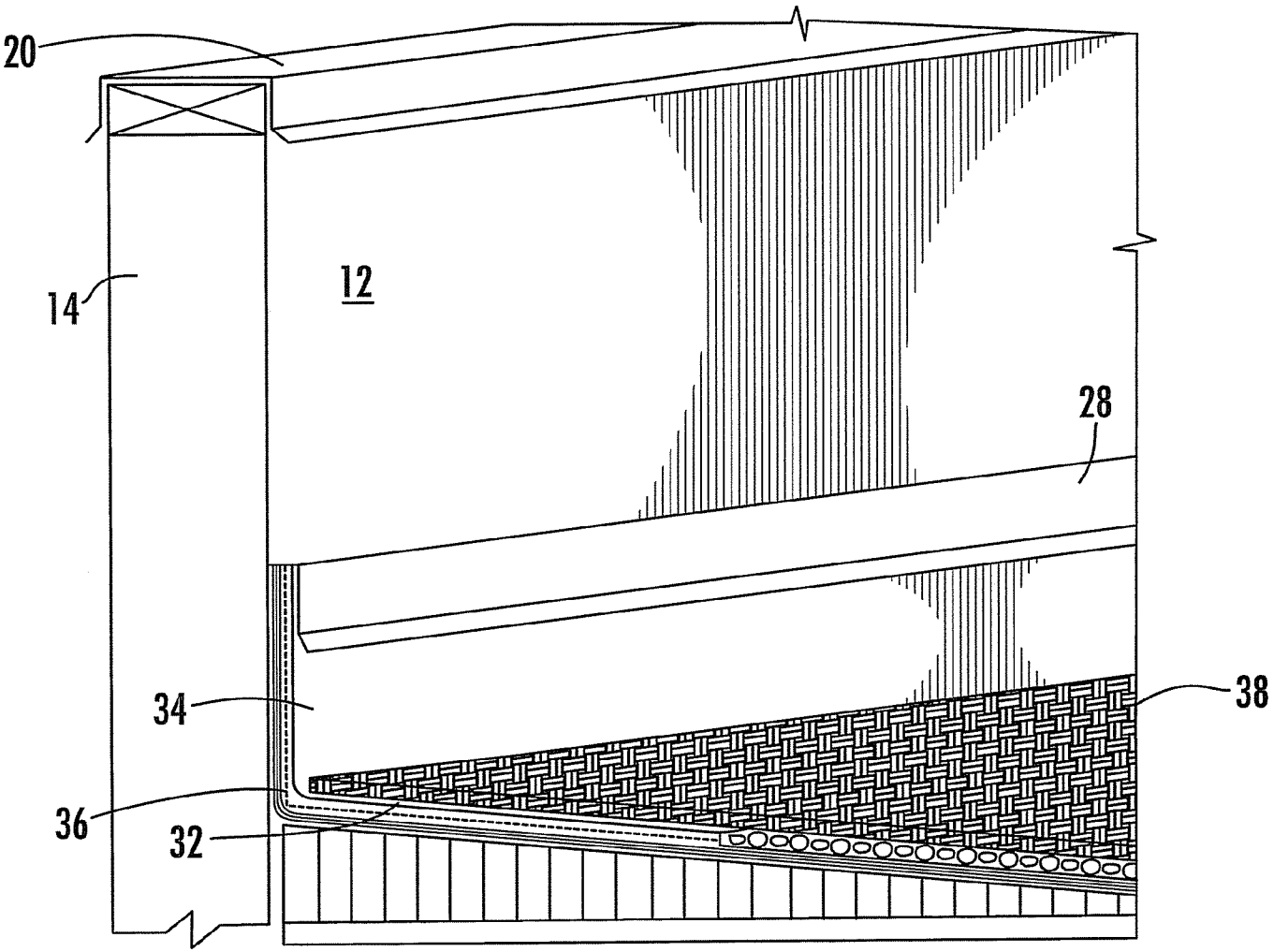
FIG. 3 is a schematic perspective view of the parapet wall and roof of FIG. 1, wherein part of an exemplary embodiment of the system for waterproofing interior surfaces of parapet walls is shown.

Referring now to FIGS. 2 and 3, an adhesive layer 30, such as atactic polypropylene (APP) or styrene-butadiene-styrene (SBS) mastic, is applied to roof 16 and walls 14. As shown in FIG. 2, the adhesive layer 30 includes a horizontal portion 32 that is disposed over a portion of the roof 16 adjacent to the wall 14, and a vertical portion 34 that covers some existing wall flashing 36 disposed below the counter flashing 28. As shown in FIG. 3, a gravel mat 38 may be laid over the roof 16 and horizontal portion 32 of the adhesive layer 30. If the gravel mat 38 and adhesive layer 30 are employed, the horizontal portion 32 of the adhesive layer 30 aids in affixing the mat 38 to the roof 16.

Figure 4:
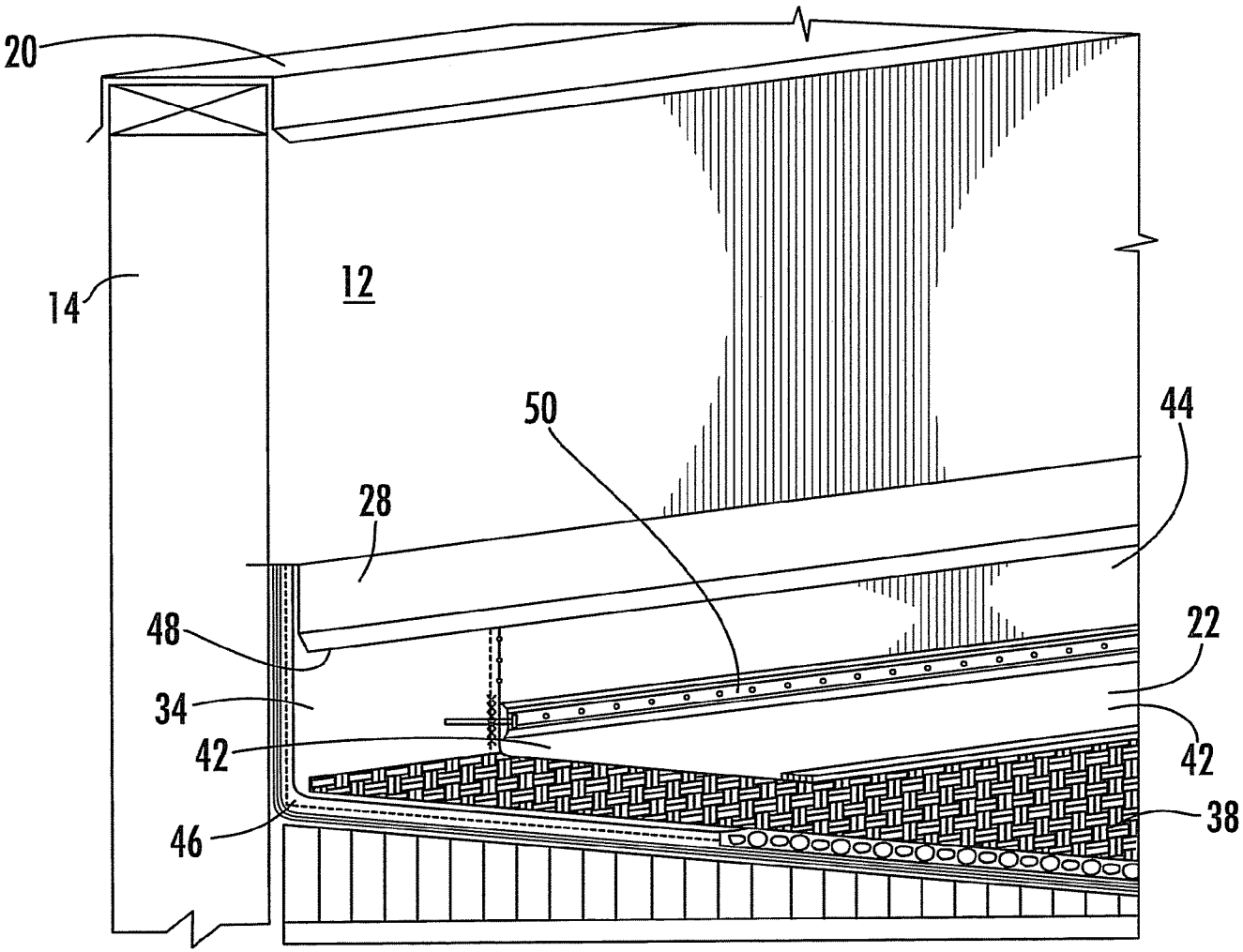
FIG. 4 is a schematic perspective view of the parapet wall and roof of FIG. 1, wherein part of an exemplary embodiment of the system for waterproofing interior surfaces of parapet walls is shown.

Referring now to FIG. 4, the skirt membrane 22, which includes a horizontal skirt portion 42 and vertical skirt portion 44, is applied to portions of the roof 16 and wall 14, respectively. The horizontal skirt portion 42 is disposed upon the gravel mat 38, substantially parallel to the roof 16. The vertical skirt portion 44 turns up interior surface 12 of the parapet wall 14 at a turn 46 between the roof 16 and wall 14. The vertical skirt portion 44 is disposed in contact with the vertical portion 34 of the adhesive layer 30, which helps attach the vertical skirt portion 44 to interior surface 12. As shown in FIG. 4, the vertical skirt portion 44 is disposed substantially parallel to the interior surfaces 12, and is positioned to extend from the roof 16 (i.e. the turn 46 between the roof 16 and wall 14) to a point at or beneath the lower extent 48 of the counter flashing 28. The vertical skirt portion 44 may also be flashed to the interior surface 12 via skirt flashing 50.

Figure 5:
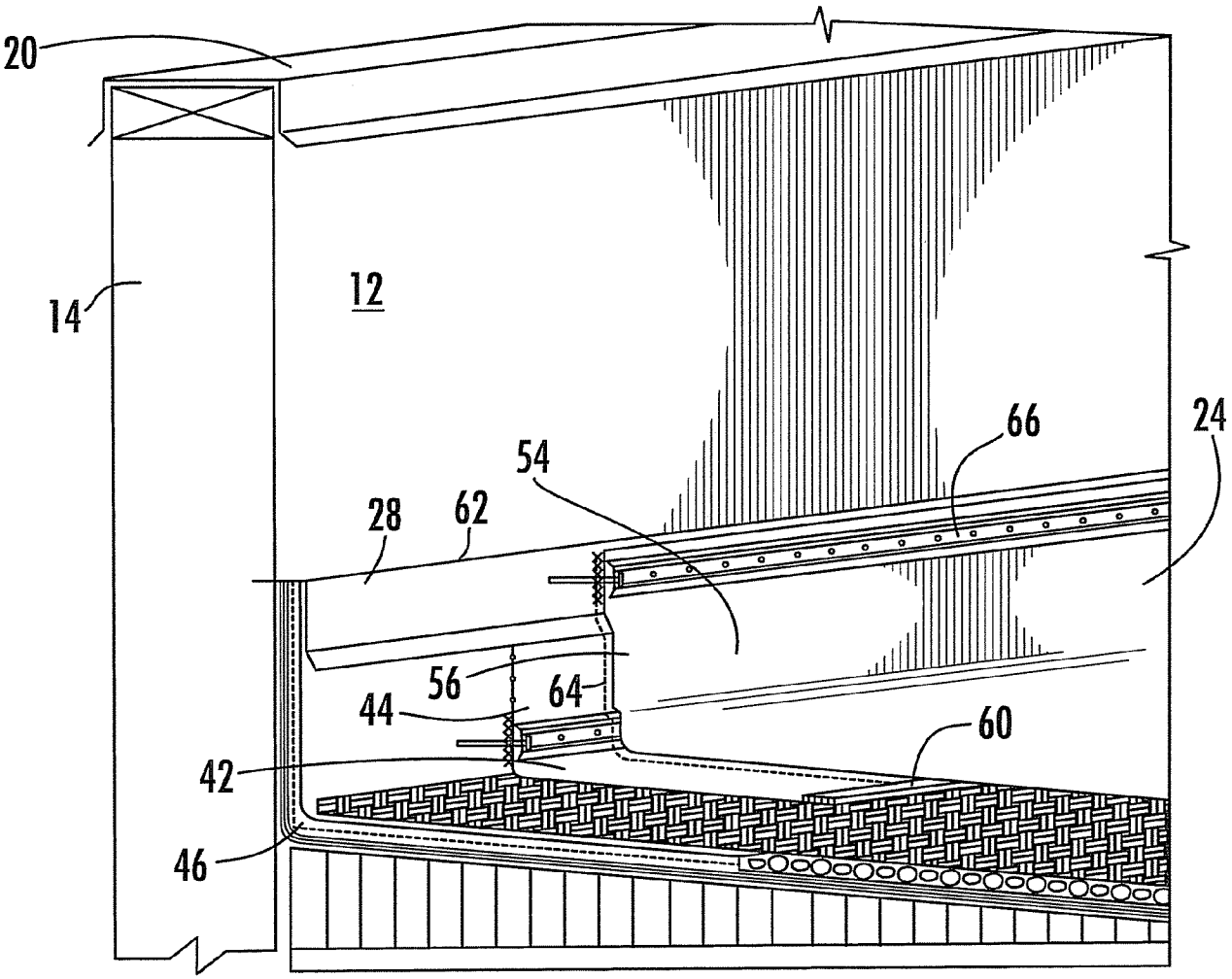
FIG. 5 is a schematic perspective view of the parapet wall and roof of FIG. 1, wherein part of an exemplary embodiment of the system for waterproofing interior surfaces of parapet walls is shown.

Referring now to FIG. 5, the field membrane 24, which includes a horizontal field portion 54 and a vertical field portion 56, is applied to the system 10. The horizontal field portion 54 is upwardly disposed of the horizontal skirt portion 42 and gravel mat 38, extending out (away from the wall 14) over the roof 16 past an extent 58 of the horizontal skirt portion 42 that is most distant from the wall 14. A spacing structure 60, such as seam tape, is disposed between the horizontal skirt portion 42 (at an area over the extent 58) and the horizontal field portion 54. As shown in FIG. 5, the horizontal field portion 54 is disposed substantially parallel to the roof 16.

The vertical field portion 56 is disposed substantially parallel to the interior surfaces 12 of the parapet walls 14, extending from the turn 46 to a point at or beneath an upper extent 62 of the counter flashing 28. The vertical field portion 56 is disposed in contact with the vertical skirt portion 44 and the portion of the counter flashing 28 that the vertical field portion 56 extends over. As shown in FIG. 5, the vertical field portion 56 may be adhered to both the vertical skirt portion 44 and counter flashing 28 (the adhering being represented at dashed line 64), and flashed to the counter flashing 28 via field flashing 66.

Figure 6:
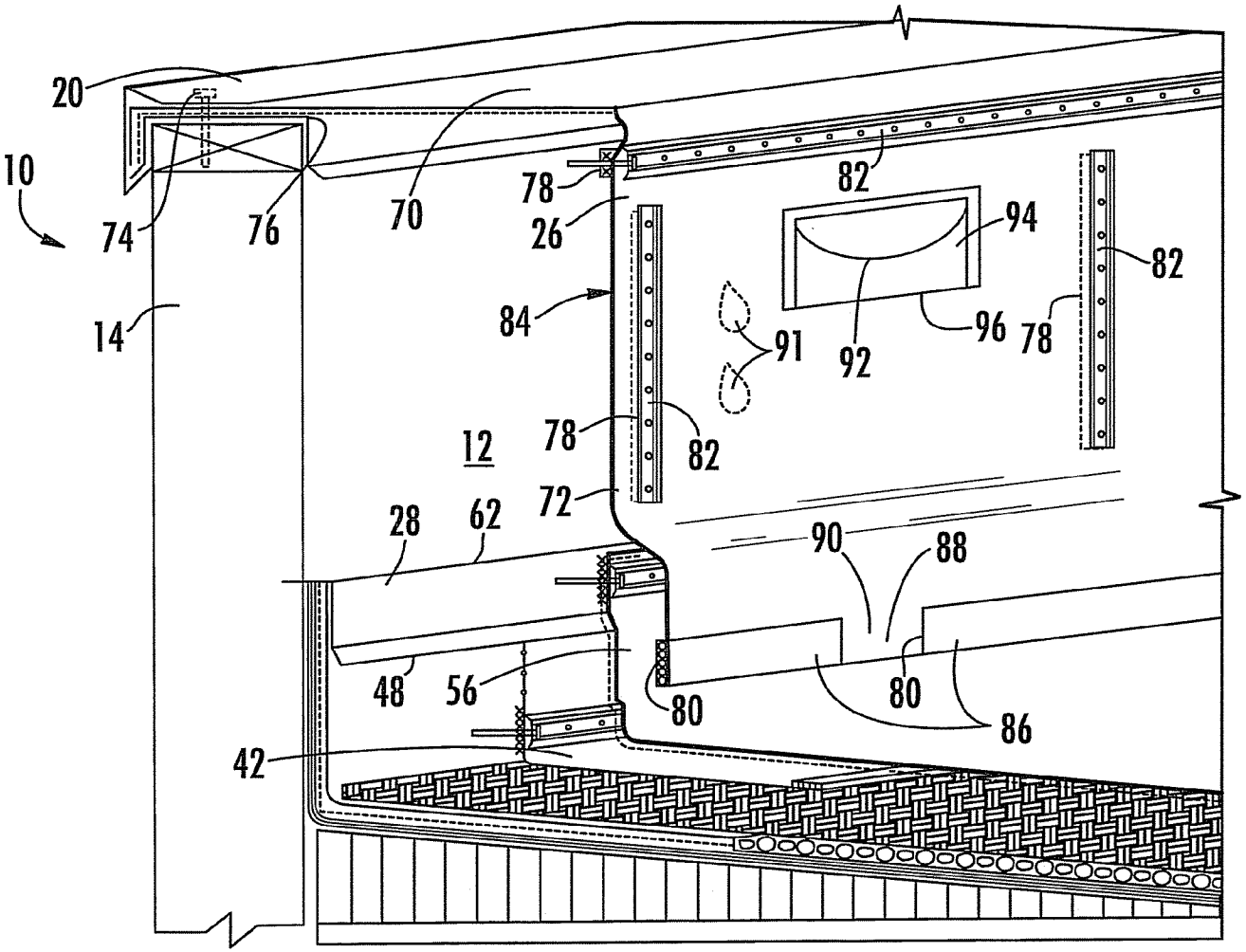
FIG. 6 is a schematic perspective view of the parapet wall and roof of FIG. 1, wherein an exemplary embodiment of the system for waterproofing interior surfaces of parapet walls is shown.

Referring now to FIG. 6, a primary waterproofing membrane 26, which includes a horizontal waterproofing portion 70 and a vertical waterproofing portion 72 is applied to the system 10. The horizontal waterproofing portion 70 is affixed to the surface cap 20 via mechanical fastener 74 (though the portion 70 may also be adhered to the cap 20). At an interior edge 76 of the surface cap 20 the primary waterproofing membrane 26 turns down, and the vertical waterproofing portion 72 begins. The vertical waterproofing portion 72 extends substantially parallel to the interior surface 12 of the parapet wall 14, covering a portion of the interior surface 12 that extends from the cap 20 to a point below the lower extent 48 of the counter flashing 28. The portion of the vertical waterproofing portion 72 that extends past the lower extent 48 of the counter flashing 28 overlaps the vertical field portion 56.

As shown in FIG. 6, a plurality of spacing structures are disposed between the vertical waterproofing portion 72 and the interior surface 12, as well as between the relatively lower extent of the vertical waterproofing portion 72 and the vertical field portion 56. In the exemplary embodiment of FIG. 6, the spacing structures between the vertical waterproofing portion 72 and the interior surface 12 are flash spacing structures 78, and the spacing structures between the relatively lower extent of the vertical waterproofing portion 72 and the vertical field portion 56 are seam spacing structures 80 (such as seam tape). The flash spacing structures 78 may be disposed in alignment with flashing 82, which affixes the vertical waterproofing portion 72 to the interior surface 12. The flash spacing structures 78 create a space 84 between the vertical waterproofing portion 72 and the interior surface 12.

The seam spacing structures 80 are non-continuous, and thus form a broken affixing seam 86 that affixes the vertical waterproofing portion 72 to vertical field portion 56. The broken affixing seam 86 includes openings 88 that are configured to create open channels 90 between the vertical waterproofing portion 72 and the vertical field portion 56. These channels 90 allow moisture 91 that accumulates, such as by condensation, in the space 84 between the vertical waterproofing portion 72 and the interior surface 12 to flow out of the space 84 to the horizontal field portion 54. As such, these channels 90 effectively allow moisture 91 to weep out of the space 84.

Also shown in FIG. 6 is a flap valve 92 that is defined by the vertical waterproofing portion 72. The flap valve 92 is essentially a smile shaped cut in the vertical waterproofing portion 72, which is positioned between the surface cap 20 and roof 16. The valve 92 is configured to equalize wind pressure, and thus may be further positioned in areas of high wind vortex activity in the system 10 in general. These areas may include the inside corners of parapet walls that at least partially surround the roof 16. The valve 92 also provides moisture venting at these areas. Liquid moisture is prevented from entering the valve 92 via a cover membrane 94, which is sealed to the vertical waterproofing portion 72 at an area relatively above and to the sides of the valve 92. As shown in FIG. 6, the cover membrane 94 is not sealed at an area relatively below the valve 92. This area provides an opening 96 that allows pressure under the roof 16 to escape, allowing the equalization of wind pressure discussed above.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or substance to the teachings of the invention without departing from the scope thereof. Therefore, it is important that the invention not be limited to the particular embodiment disclosed as the best mode contemplated for carrying out this invention, but that the invention will include all embodiments falling within the scope of the apportioned claims. Moreover, unless specifically stated any use of the terms first, second, etc. do not denote any order or importance, but rather the terms first, second, etc. are used to distinguish one element from another.

What is claimed is:

1. A system for waterproofing interior surfaces of parapet walls disposed on a roof, the parapet walls including an interior surface counter flashing and a surface cap, the system comprising:

at least one waterproofing membrane configured to allow moisture to escape from a space between said at least one waterproofing membrane and the interior surfaces of the parapet walls, said at least one waterproofing membrane being disposed to extend at least a portion of a distance along the interior surfaces from the surface cap to the roof from which the parapet walls extend; and a flap valve defined by said at least one waterproofing membrane, said flap valve being positioned between the surface cap and the roof.

2. The system of claim 1, wherein said at least one waterproofing membrane is a plurality of membranes.

3. The system of claim 2 wherein said plurality of membranes are a field membrane and a primary waterproofing membrane, said field membrane including:

a horizontal field portion that extends substantially parallel to and upwardly of the roof, and a vertical field portion that extends substantially parallel to the interior surfaces of the parapet walls, said vertical field portion being affixed to the counter flashing and positioned to extend from the roof to a point at or beneath an upper extent of the counter flashing; and said primary waterproofing membrane extending substantially parallel to the interior surfaces of the parapet walls and said vertical field portion, said waterproofing membrane being disposed to at least cover the interior surfaces at a portion disposed above said upper extent of counter flash, said waterproofing membrane being affixed to the interior surfaces.

4. The system of claim 3, further including a non-continuous spacing structures configured to affix said primary waterproofing membrane to said vertical field portion, wherein said flap valve is defined by said waterproofing membrane.

5. The system of claim 4, further including a skirt membrane that includes a horizontal skirt portion and vertical skirt portion, said horizontal skirt portion being disposed substantially parallel to and upwardly of the roof, between the roof and said horizontal filed portion, and said vertical portion being disposed substantially parallel to the interior surfaces between the interior surfaces and vertical field portion, said vertical skirt portion being affixed to the interior surfaces and positioned to extend from the roof to a point at or beneath said lower extent of the counter flashing.

6. The system of claim 3, wherein said vertical field portion is affixed to the counter flashing via flashing, and wherein said primary waterproofing membrane is affixed to the interior surfaces via flashing.

7. The system of claim 5, wherein said vertical skirt portion is affixed to the interior surfaces via flashing.

8. The system of claim 1, wherein said flap valve is positioned in areas of high wind vortex activity, and configured to equalize wind pressure and provide moisture venting.

9. The system of claim 4, wherein spacing structures are disposed between said waterproofing membrane and said interior surfaces.

10. The system of claim 4, wherein said non-continuous spacing structures forms a broken affixing seam between said primary waterproofing membrane and said vertical field portion, said broken affixing seam including openings that are configured to create open channels between said primary waterproofing membrane and said vertical field portion.

11. The system according to claim 10, wherein said channels are configured to allow moisture that accumulates in said space between said primary waterproofing membrane and the interior surfaces to flow out of said space.

12. The system of claim 10, wherein said non-continuous spacing structures are pieces of seam tape.

13. The system of claim 3, wherein said primary waterproofing membrane includes a horizontal waterproofing portion that is affixed to the surface cap of the parapet walls.

14. The system of claim 5, wherein said field membrane is adhered to said skirt membrane, and wherein said field membrane is adhered to the interior surfaces at or beneath said lower extent of the counter flashing.

15. The system of claim 5, wherein a spacer is disposed between said horizontal field portion and said horizontal skirt portion.

16. The system of claim 5, wherein gravel board is disposed between said horizontal skirt layer and the roof.

17. The system of claim 16, wherein an adhesive layer is disposed between said gravel board and said roof, apportion of said adhesive layer being affixed to a portion of the interior surface below said lower extent of the counter flashing.

18. The system of claim 1, wherein said flap valve is covered by a membrane configured to prevent moisture from entering said flap valve, said membrane including an opening configured to allow wind to enter said flap valve.

19. A method for waterproofing interior surfaces of parapet walls disposed on a roof, the parapet walls including an interior surface counter flashing and a surface cap, the method comprising:

disposing at least one waterproofing membrane to extend at least a portion of a way down the interior surfaces from the surface cap to the roof from which the parapet walls extend upwards;

configuring said at least one waterproofing membrane to allow moisture to escape from a space between said at least one waterproofing membrane and the interior walls;

providing a flap valve in said at least one waterproofing membrane, said flap valve being positioned between the surface cap and the roof; and removing said moisture from said space via said configuring and equalizing wind pressure on said at least one waterproofing membrane via said providing.

20. Waterproof parapet walls disposed on a roof, the walls comprising interior surfaces disposed to face inwardly toward the roof;

a counter flashing disposed on said interior surface;

a surface cap disposed on an upper extent of the parapet walls;

at least one waterproofing membrane disposed to extend at least a portion of a way down said interior surfaces from said surface cap to the roof from which the waterproof parapet walls extend upwards, wherein said at least one waterproofing membrane is configured to allow moisture to escape from a space between said at least one waterproofing membrane and said interior walls; and a flap valve defined by said at least one waterproofing membrane, said flap valve being positioned between said surface cap and the roof.

* * * * *